United States Patent [19]

Kindig et al.

[11] 4,098,584

[45] Jul. 4, 1978

[54] REMOVAL OF IMPURITIES FROM COAL

[75] Inventors: James K. Kindig, Arvada; Ronald L. Turner, Golden, both of Colo.

[73] Assignee: Hazen Research, Inc., Golden, Colo.

[21] Appl. No.: 767,659

[22] Filed: Feb. 10, 1977

[51] Int. Cl.[2] ..... C10L 9/10; C10B 57/00

[52] U.S. Cl. ..... 44/1 R; 201/17

[58] Field of Search ..... 44/1 R; 201/17

[56] References Cited

U.S. PATENT DOCUMENTS

| | | | |
|---|---|---|---|
| 2,726,148 | 12/1955 | McKinley et al. | 44/1 R |
| 3,595,965 | 7/1971 | Franz et al. | 201/17 X |
| 3,938,966 | 2/1976 | Kindig et al. | 44/1 R |

*Primary Examiner*—Carl F. Dees

*Attorney, Agent, or Firm*—Sheridan, Ross, Fields & McIntosh

[57] ABSTRACT

The magnetic susceptibility of various impurities contained within coal is increased by simultaneously co-treating the coal with a metal containing compound and a gas selected from the group consisting of hydrogen and carbon monoxide.

32 Claims, No Drawings

REMOVAL OF IMPURITIES FROM COAL

BACKGROUND OF THE INVENTION

1. Field of the Invention

The process of the present invention relates to the improvement of the properties of coal, and is classified generally in the class relating to fuels and igniting devices.

2. The Prior Art

With the present world-wide emphasis on the energy crisis and the rapidly diminishing sources of oil, increased attention by both government and private organizations is being given to coal as a source of energy, especially for the generation of electricity. This country has vast resources of coal for development as other sources of energy diminish.

Depending upon their origin, coals contain varying amounts of iron disulfide (iron disulfide is hereinafter referred to as pyrite whether crystallized as pyrite or marcasite) from which sulfur dioxide is formed as a combustion product when coal is burned. This is a tremendous disadvantage to the use of coal as an energy source, particularly in view of the current emphasis on pollution controls as illustrated by present federal emission control standards for sulfur dioxide. Illustrating the enormity of the sulfur dioxide emission problem is the fact that large transportation expenses are incurred by coal users in transporting Western and European coals of relatively low sulfur content long distances to supplant available high sulfur-containing coals in order to comply with sulfur dioxide emission standards. At this time there are no effective means available which are commercially feasible for absorbing the large amounts of sulfur dioxide emitted by the combustion of coal to product heat and electricity. One solution to the problem is to separate the sulfur-bearing pyrite from the coal before it is burned.

Coals also contain, depending upon their origin, various amounts and kinds of minerals which form ash when the coal is burned. The ash also is a disadvantage to the use of coal as an energy source, since it contributes no energy value during combustion. The ash causes a dilution of the calorific value of the coal, and causes a waste disposal problem and a potential air pollution problem.

The problem of separating pyrite and/or other impurities from raw coal is not new and a number of methods have been extensively tested over the years. Among these are methods which employ the difference in specific gravity between coal particles and the impurity particles or differences in their surface, electrostatic, chemical, or magnetic properties. For various reasons difficulties are encountered in making an efficient separation of pyrite or other impurities from coal which has been ground finely enough to substantially liberate impurity particles from coal particles. In water systems this difficulty is related to the slow settling rate of fine particles, and in air systems to the large difference in specific gravity between air and the particles. However, for magnetic separations the magnetic attraction force acting on small magnetic particles is many times greater than the opposing force, which is usually a hydraulic drag and/or gravity force.

For the separation of pyrite or other impurities from raw coal the success of a magnetic process is dependent upon some effective treatment process for selectively enhancing the magnetic susceptibility of the pyrite or other impurity. Coal particles alone are slightly diamagnetic while pyrite and many other mineral impurities are weakly paramagnetic; however, their paramagnetism has not been sufficient to economically effect a separation from coal. However, effective beneficiation of coals can be made if the magnetic susceptibility of pyrite or other impurities is increased. For pyrite it has been estimated that a sufficient increase in susceptibility can be achieved by converting less than 0.1 percent of pyrite in pyritic coal into ferromagnetic compounds of iron. ("Magnetic Separation of Pyrite from Coals," Bureau of Mines Report of Investigations 7181, p.1.)

In discussing the use of heat to enhance the paramagnetism of pyrite it is stated in the above report (p.1) that ferromagnetic compounds of iron are not formed in significant quantities at temperatures below 400° C, and that such conversion occurs in sufficient quantities to effect beneficiation only at temperatures greater than 500° C. As this is above the decomposition temperature of coal, the use of heat to enhance the magnetic susceptibility of impurities does not appear feasible. Further, other methods for enhancing the paramagnetism of pyrite to permit its separation from coal have not been encouraging.

The same report (p.6) also investigated the effect of heat treatment with various gases, e.g., hydrogen, carbon monoxide, carbon dioxide, nitrogen, concluding that none of the treatments could be contemplated for any practical process because the residence time of the treatments was excessive. The only significant reduction of sulfur which gave a reasonable yield occurred in a hydrogen atmosphere at 300° C with a residence time of five hours. It was further stated in this report that other methods for enhancing the paramagnetism of pyrite to permit its separation from coal have not been encouraging.

U.S. Pat. No. 3,938,966 discloses a process for improving coal wherein the raw coal is reacted with substantially undecomposed iron carbonyl which alters the magnetic susceptibility of certain impurity components contained in the raw coal, thereby permitting their removal by low-intensity magnetic separators. This process represents a noteworthy advance in the art, as treating coal in accordance with this process may substantially remove impurities such as pyrite, a primary contributor to sulfur dioxide pollution problems. The process of this patent, however, does not appear to possess universal applicability with an equal degree of success in that while many coals are substantially enhanced by this treatment, certain other coals are not as receptive. It has been discovered by the inventors of the present application that cotreating coal with a metal containing compound and hydrogen or carbon monoxide gas under various conditions as hereinafter presented substantially enhances the effectiveness of the process of this patent.

SUMMARY OF THE INVENTION

The process of the present invention entails simultaneously cotreating raw coal with a metal containing compound and hydrogen or carbon monoxide gas under conditions such as to enhance the magnetic susceptibility of certain impurities contained in raw coal, thereby permitting removal of the affected impurities by magnetic means.

DESCRIPTION OF THE PREFERRED EMBODIMENT

The process of the present invention can be applied to coals of universal origin, as long as the coal contains one or more impurities receptive to the described treatment. The process employs a metal containing compound and a gas cotreatment in order to enhance the magnetic susceptibility of an impurity. By selectively enhancing this property of the impurity, while not affecting the coal itself, a magnetic separation may be conventionally accomplished to remove the impurity from the coal. The coal is therefore left in a more pure state, rendering it more suitable for combustion.

"Enhancing the magnetic susceptibility" of a particle or an impurity as used herein is intended to be defined in accordance with the following discussion. Every compound of any type has a specifically defined magnetic susceptibility, which refers to the overall attraction of the compound to a magnetic force. An alteration of the surface characteristics will alter the magnetic susceptibility. The metal and gas cotreatment of the basic process alters the surface characteristics of an impurity in order to enhance the magnetic susceptibility of the impurity. It is to be understood that the magnetic susceptibility of the impurity is not actually changed, but the particle itself is changed, at least at its surface, resulting in a particle possessing a greater magnetic susceptibility than the original impurity. For convenience of discussion, this alteration is termed herein as "enhancing the magnetic susceptibility" of the particle or impurity itself.

The impurities with which the process of the present invention may be utilized include those impurities which react with one or more of the metal containing compounds and gases hereinafter described to form a product possessing an enhanced magnetic susceptibility. Examples of such impurities include pyrite; ash-forming minerals, such as clays and shales; and various sulfates, for example, calcium sulfate and iron sulfate. For purposes of illustration the discussion hereinafter often refers to pyrite, but it is to be understood that all suitable impurities are affected in similar fashion.

Numerous metal containing compounds are suitable to impart this magnetic susceptibility. A number of different mechanisms are believed to be involved in what is termed herein as the "treatment" and/or magnetic susceptibility enhancement "reaction" depending upon the metal containing compound or compounds and the reaction conditions employed. Some metal containing compounds, with metals more magnetic than the impurities, principally iron, under certain conditions coat the impurity with the metal, thereby enhancing the magnetic susceptibility of the impurity. Some metal containing compounds affect the pyrite by combining with some of the pyrite sulfur to yield an iron sulfide more magnetic than pyrite. The following reaction exemplifies this mechanism:

$$6M + 7FeS_2 \rightarrow Fe_7S_8 + 6MS$$

Similarly ash, such as $Fe_2O_3$, may react with a metal to form a more strongly magnetic compound, as for example, in accordance with the following reaction:

$$M + 3Fe_2O_3 \rightarrow MO + 2Fe_3O_4$$

In similar fashion, U.S. Pat. No. 3,938,966 and the reaction mechanisms illustrated therein with respect to pyrite and iron pentacarbonyl present viable techniques for enhancing the magnetic susceptibilities of impurities.

Other mechanisms undoubtedly also contribute to the enhancing of the magnetic susceptibility, and again this is principally determined by the particular metal containing compound or compounds employed and the reaction conditions. It is to be understood that in view of the disclosures herein presented, the selection of a given metal compound and gas along with the most desirable reaction conditions to be employed with the given metal compound and gas cannot be itemized for each and every combination due to the number of variables involved. However, the proper selection will be apparent to one skilled in the art with but a minimal amount of experimentation, and it is sufficient to note that the improvement of the invention herein set forth relates to all of these compounds.

Many organic iron containing compounds possess the capability of enhancing the magnetic susceptibility of coal impurities, as long as the compound is adaptable so as to bring the iron in the compound into contact with the impurity under conditions such as to cause an alteration of at least a portion of the surface of the impurity. Organic iron containing compounds capable of exerting sufficient vapor pressure, with iron as a component in the vapor, so as to bring the iron into contact with the impurity at the reaction temperature are suitable, as well as other organic iron containing compounds which can be dissolved and/or "dusted" and brought into contact with the impurity.

Preferred compounds within the vapor pressure group are those which exert a vapor pressure, with iron as a component in the vapor, of at least about 10 millimeters of mercury, more preferably at least about 25 millimeters of mercury, and most preferably at least about 50 millimeters of mercury at the reaction temperature. Examples of groupings which fall within this vapor pressure definition include ferrocene and its derivatives and $\beta$-diketone compounds of iron. Specific examples include ferrocene, dimethyl ferrocenedioate, 1,1'-ferrocenedicarboxylic acid, ferric acetylacetonate, and ferrous acetylacetonate.

Other organic compounds which may be utilized to enhance the magnetic susceptibility include those which may be dissolved and brought into contact with the impurities. These compounds must have sufficient solubility so as to provide sufficient metal to contact the surface of the impurity. Preferably the solubility is at least about 1 gram per liter, more preferably at least about 10 grams per liter, and most preferably at least about 50 grams per liter at injection temperature. The solvent must, of course, possess the capability of dissolving organic compounds within the above set forth concentrations, and preferably not create side reaction problems tending to detract from the effectiveness of the process. Suitable solvents include, for example, acetone, petroleum ether, naphtha, hexane, and benzene; but this is, of course, dependent upon the particular metal compound being employed.

A grouping which falls within this solution definition includes the carboxylic acid salts of iron; and specific examples include iron octoate, iron naphthenate and iron stearate.

Additionally, solid organic iron containing compounds capable of being directly mixed with the coal in solid form possess the capability of enhancing the magnetic susceptibility of coal impurities. The compound must be in solid form at the treatment temperature and be of sufficiently fine particle size in order to be able to be well dispersed throughout the coal. The particle size is preferably smaller than about 20-mesh, more preferably smaller than about 100-mesh, and most preferably smaller than about 400-mesh. Compounds within this grouping include ferrocene and its derivatives, iron salts of organic acids, and β-diketone compounds of iron. Specific examples include ferrous formate, 1,1'-diacetyl ferrocene, and 1,1'-dihydroxymethyl ferrocene.

Various inorganic compounds are also capable of producing an enhanced magnetic susceptibility. Preferred inorganic compounds include metal carbonyls, including, for example, iron, nickel, cobalt, molybdenum, tungsten, and chromium carbonyls and derivatives of these compounds. Iron carbonyl is a preferred carbonyl for imparting this magnetic susceptibility, particularly iron pentacarbonyl, iron dodecacarbonyl, and iron nonacarbonyl.

The most preferred metal containing compound capable of enhancing the magnetic susceptibility is iron pentacarbonyl. The process is applied by contacting the raw coal which is liberated from pyrite or other impurities with iron carbonyl under conditions such that there is an insufficient dissociation of carbonyl into metal and carbon monoxide to cause substantial deposition of metal on the coal particles. These conditions are determined by the temperature, the type of carbonyl, pressure, gas composition, etc. Ordinarily, the carbonyl gas is heated to a temperature just below its decomposition temperature under the reaction conditions. Various types of available equipment can be used for contacting the iron carbonyl and coal, such as a rotating kiln used as the reaction vessel with iron carbonyl vapors carried into contact with the tumbling contents of the kiln by a gas such as nitrogen, which is inert to the reaction process.

When carbonyl is used as the magnetic susceptibility enhancement reactant, the process must be carried out at a temperature below the temperature of major decomposition of the carbonyl under the reaction conditions so that there is opportunity for the iron of the carbonyl to react with the pyrite particles. If the temperature is allowed to rise above the decomposition temperature, the selectivity of the process of enhancing the magnetic susceptibility of one or more impurities without affecting the coal is impaired.

Most preferably the iron pentacarbonyl treatment is performed by contacting the coal with the carbonyl for a time of from about one-half to about four hours at a temperature of from about 150° to about 200° C and a carbonyl concentration of from about 2 to about 16 kilograms per metric ton of coal.

The improvement of the process of the invention concerns treating the coal with a metal containing compound as hereinabove discussed, while simultaneously treating the coal with a gas selected from the group consisting of hydrogen and carbon monoxide. These gases in and of themselves have no appreciable effect upon the magnetic susceptibility of the coal impurities; however, they significantly improve the results obtained over the metal containing compound treatments in the absence of the gases.

The type and amount of gas will depend to some extent upon the metal containing compound being used. Generally, the gas will be employed at a rate of preferably at least about 1, more preferably at least about 5, and most preferably at least about 10 liters per kilogram of coal.

The preferred parameters are dependent upon the specific impurities being treated, the specific compounds employed as the treating agent, and other factors. Hence, some experimentation to determine the optimum conditions for each specific system is preferred. Generally, the cotreatment will be carried out within a temperature range of from about 100° to about 400° C, more preferably from about 200° to about 350° C, and most preferably from about 240° to about 300° C; for a time of preferably at least about 0.1, more preferably at least about 0.25, and most preferably at least about 0.5 hours; with from about 1 to about 80, more preferably from about 2 to about 50, and most preferably from about 5 to about 30 kilograms of metal containing compound per metric ton of coal.

For efficient separations of pyrite from coal, the coal should be crushed to such fineness that pyrite particles are free, or nearly free, from the coal particles. The required fineness depends upon the size distribution of the pyrite in the coal. A thorough treatment of the subject for power plant coals is given in the article entitled "Pyrite Size Distribution and Coal-Pyrite Particle Association in Steam Coals," Bureau of Mines Report of Investigation 7231. The requirement for pyrite liberation applies to all types of physical separations and so is not a disadvantage of this invention. Additionally, present technology for coal-fired power plants generally requires pulverizing the coal to 60–90 percent minus 200 mesh before burning.

Prior to subjecting the coal to this cotreatment with a metal containing compound and gas to enhance the magnetic susceptibility of the coal, the coal can undergo pretreatment by heat or steam or pretreatment to remove at least a portion of the elemental sulfur contained within the raw coal or any other pretreatment which will enhance the magnetic susceptibility of the impurities contained within the coal. Such pretreatments are discussed in copending applications Ser. No. 761,307, filed Jan. 21, 1977, and Ser. No. 764,390, filed Jan. 31, 1977.

EXAMPLES

In each of the examples, the coal sample was separated in a magnetic separator following the described treatment to give a non-magnetic clean coal fraction and a magnetic refuse fraction.

The methods of application as given in the Tables are defined as follows:

DM: The compound was directly mixed with coal, which was then heated stepwise to operating temperature;

S/E: The compound was dissolved in suitable solvent, mixed with coal, and then dried in a stream of nitrogen. The coal was then heated stepwise to operating temperature.

Inj: The coal was heated stepwise to the maximum temperature, while the compound was vaporized externally and injected as vapor into the reaction chamber.

EXAMPLE 1

A series of 75 gram samples of Pittsburgh Seam Coal, sized to 14-mesh by 0 and having no pretreatments, was treated with various iron compounds as indicated in Table 1. As Table 1 further indicates, each iron compound was employed alternately with hydrogen (200 milliliters per minute) and nitrogen, the nitrogen simply serving as an inert carrier. The nitrogen samples therefore indicate the effect of the iron containing compound alone on the impurities analyzed and reported.

EXAMPLE 2

A series of comparative samples were made on Pittsburgh Seam Coal, sized 14-mesh by 0, having no pretreatment, the tests comprising alternately treating the coal samples with various volatile ferrocene compounds in a carbon monoxide atmosphere and a nitrogen atmosphere. In each sample, the ferrocene compound was vaporized and then injected as a vapor into the reaction chamber as the coal was heated stepwise to the maximum temperature indicated in Table 2. The operating conditions and results are presented in Table 2.

EXAMPLE 3

Table 3 presents a series of samples of Pittsburgh Seam coal, size 14-mesh by 0, each sample having been cotreated with the indicated iron compound and gas in one test and the respective iron compound alone in another test. The coal in Sample 1 was steam pretreated with 192 kilograms of water per metric ton of coal for one hour at 200° C. The coal of Samples 2-6 received no pretreatment.

Table 1

| Sample Number | Iron Compound | Cotreating Gas | Iron Containing Compound Kg/Metric Ton | Method of Application | Maximum Temp, ° C | Clean Coal Analysis Yield, Wt. % | Ash, % | Pyritic Sulfur, % |
|---|---|---|---|---|---|---|---|---|
| 1 | Iron (II) Formate | $H_2$ | 32 | DM | 250 | 92.2 | 20.8 | 1.42 |
| 2 | Iron (II) Formate | $N_2$ | 32 | DM | 250 | 97.9 | 20.5 | 1.96 |
| 3 | Iron (III) Octoate | $H_2$ | 36.3 | S/E | 275 | 46.0 | 9.2 | 0.69 |
| 4 | Iron (III) Octoate | $N_2$ | 32 | S/E | 275 | 85.9 | 19.3 | 1.99 |
| 5 | Iron (III) Chloride | $H_2$ | 68.8 | DM | 275 | 86.7 | 21.3 | 1.30 |
| 6 | Iron (III) Chloride | $N_2$ | 68.1 | DM | 250 | 95.8 | 21.9 | 1.85 |
| 7 | Iron (II) Chloride | $H_2$ | 46.2 | DM | 275 | 92.8 | 20.8 | 1.10 |
| 8 | Iron (II) Chloride | $N_2$ | 49.3 | DM | 260 | 98.9 | — | — |
| 9 | Iron (II) Acetylacetonate | $H_2$ | 16 | S/E | 275 | 88.9 | 18.7 | 1.43 |
| 10 | Iron (II) Acetylacetonate | $N_2$ | 16.7 | S/E | 300 | 90.0 | 17.7 | 1.90 |
| 11 | Iron (III) Acetylacetonate | $H_2$ | 16 | S/E | 300 | 45.7 | 13.1 | 1.23 |
| 12 | Iron (III) Acetylacetonate | $N_2$ | 16 | S/E | 295 | 70.1 | 13.9 | 1.48 |
| 13 | Iron (III) Benzoylacetonate | $H_2$ | 32 | S/E | 275 | 87.7 | 17.6 | 1.25 |
| 14 | Iron (III) Benzoylacetonate | $N_2$ | 32 | S/E | 275 | 92.0 | 20.4 | 2.12 |
| 15 | None | $H_2$ | — | — | 300 | 98.7 | — | — |
| 16 | None | $N_2$ | — | — | 300 | 99.2 | — | — |

Table 2

| Sample Number | Iron Compound | Cotreating Gas | Iron Containing Compound Kg/Metric Ton | Maximum Temp, ° C | Clean Coal Analysis Yield, Wt. % | Ash, % | Pyritic Sulfur, % |
|---|---|---|---|---|---|---|---|
| 1 | Ferrocene | CO | 16 | 280 | 85.6 | 19.3 | 1.62 |
| 2 | Ferrocene | $N_2$ | 16 | 265 | 97.6 | 20.7 | 1.76 |
| 3 | Acetyl ferrocene | CO | 16 | 280 | 89.8 | 19.2 | 1.55 |
| 4 | Acetyl Ferrocene | $N_2$ | 12 | 270 | 96.2 | 21.1 | 1.59 |
| 5 | Ferrocene carboxylic acid | CO | 8 | 280 | 86.6 | 19.4 | 1.76 |
| 6 | Ferrocene carboxylic acid | $N_2$ | 7 | 255 | 95.9 | 20.9 | 1.62 |
| 7 | 1,1'-Ferrocene dicarboxylic acid | CO | 7.5 | 280 | 87.5 | 19.4 | 1.55 |
| 8 | 1,1'-Ferrocene dicarboxylic acid | $N_2$ | 6 | 275 | 94.9 | 21.3 | 2.00 |
| 9 | Dimethyl ferrocenedioate | CO | 15.0 | 280 | 88.4 | 19.3 | 1.58 |
| 10 | Dimethyl ferrocenedioate | $N_2$ | 12.3 | 250 | 95.7 | 20.2 | 1.54 |
| 11 | None | CO | — | 300 | 99.3 | — | — |
| 12 | None | $N_2$ | — | 300 | 99.2 | — | — |

Table 3

| Sample Number | Gas Compound | Cotreatment Gas | Iron Containing Compound Kg/Metric Ton | Method of Application | Maximum Temp. ° C | Time, Hours | Yield, Wt. % | Ash, % | Inorganic S, % |
|---|---|---|---|---|---|---|---|---|---|
| 1 | Iron carbonyl | $H_2$-15 ml/min | 16 | Inj. | 170 | 1 | 77.3 | 12.5 | 0.58 |
| | | None | 16 | Inj. | 170 | 1 | 86.8 | 12.4 | 0.65 |
| 2 | α-Hydroxyethyl ferrocene | None | 15.3 | Inj. | 250 | 1 | 97.8 | 21.1 | 2.14 |
| | | $H_2$-200 ml/min | 17.2 | Inj. | 300 | 2 | 88.1 | 18.7 | 1.01 |
| 3 | Dimethyl ferrocenedioate | None | 12.3 | Inj. | 250 | 1 | 95.7 | 20.2 | 1.54 |
| | | $H_2$-200 ml/min | 19.7 | Inj. | 300 | 2 | 87.9 | 18.7 | 1.22 |
| 4 | None | None | — | — | 300 | 1 | 99.2 | — | — |
| | None | $H_2$-200 ml/min | — | — | 300 | 2 | 98.7 | — | — |
| 5 | Iron (III) Octoate | None | 32 | S/E | 275 | 1 | 85.9 | 19.3 | 1.99 |
| | Iron (III) Octoate | CO-25 ml/min | 16.3 | S/E | 300 | 1 | 83.3 | 17.9 | 1.59 |
| 6 | None | None | — | — | 300 | 1 | 99.2 | — | — |
| | None | CO-25 ml/min | — | — | 300 | 1 | 99.3 | — | — |
| Feed | | | | | | | 100.0 | 21.1 | 1.93 |

What is claimed is:

1. In a process for improving coal wherein the coal is treated with a metal containing compound in order to enhance the magnetic susceptibility of certain impurity components contained in the raw coal permitting their removal by magnetic separation, the improvement comprising:

treating the coal with a gas selected from the group consisting of hydrogen and carbon monoxide during the metal containing compound treatment.

2. The process of claim 1 wherein the gas is hydrogen.

3. The process of claim 1 wherein the gas is carbon monoxide.

4. The process of claim 1 wherein the metal containing compound and gas treatment is conducted at a temperature of at least about 100° C for at least 0.1 hours.

5. The process of claim 1 wherein the metal containing compound is employed in an amount of from about 1 to about 80 kilograms per metric ton of coal.

6. The process of claim 1 wherein the gas is employed at a rate of at least about 1 liter per kilogram of coal.

7. The process of claim 1 wherein the impurities enhanced comprise pyrite.

8. The process of claim 1 wherein the impurities enhanced comprise ash-forming minerals.

9. The process of claim 1 wherein the metal containing compound comprises a substantially undecomposed carbonyl selected from the group consisting of iron carbonyl, nickel carbonyl, cobalt carbonyl, molybdenum carbonyl, tungsten carbonyl, chromium carbonyl, and derivatives of these carbonyls.

10. The process of claim 9 wherein the carbonyl is iron carbonyl.

11. The process of claim 9 wherein the iron carbonyl comprises iron pentacarbonyl.

12. The process of claim 1 wherein the metal containing compound is an iron containing compound.

13. The process of claim 12 wherein the iron compound is an organic iron containing compound.

14. The process of claim 13 wherein the organic iron containing compound is capable of exerting sufficient vapor pressure, with iron as a component in the vapor, so as to bring the iron into contact with the impurity at the reaction temperature.

15. The process of claim 14 wherein the vapor pressure of the organic iron containing compound is at least about 10 millimeters of mercury at the reaction temperature.

16. The process of claim 13 wherein said organic iron containing compound is selected from the group consisting of ferrocene, ferrocene derivatives, and $\beta$-diketone compounds of iron.

17. The process of claim 12 wherein the iron compound is selected from the group consisting of ferrocene, dimethyl ferrocenedioate, 1,1'-ferrocenedicarboxylic acid, ferric benzoylacetonate, ferric acetylacetonate, ferrous acetylacetonate, ferric octoate, $\alpha$-hydroxyethyl ferrocene, and ferrous formate.

18. The process of claim 12 wherein the iron compound is an ester of a ferrocene carboxylic acid derivative.

19. The process of claim 18 wherein the ester of a ferrocene carboxylic acid derivative is dimethyl ferrocenedioate.

20. The process of claim 12 wherein the iron compound is a simple iron salt of a monobasic or dibasic organic acid.

21. The process of claim 20 wherein the iron salt of a monobasic organic acid is iron formate.

22. The process of claim 12 wherein the iron compound is a $\beta$-diketone.

23. The process of claim 22 wherein the $\beta$-diketone iron compound is selected from the group consisting of ferric benzoylacetonate, ferric acetylacetonate and ferrous acetylacetonate.

24. The process of claim 12 wherein the iron compound is an iron salt of a carboxylic acid.

25. The process of claim 24 wherein the iron salt of a carboxylic acid is a ferric octoate.

26. The process of claim 12 wherein the iron compound is a hydroxyalkyl derivative of ferrocene.

27. The process of claim 12 wherein the iron containing compound comprises ferrous chloride.

28. The process of claim 12 wherein the iron containing compound comprises ferric chloride.

29. The process of claim 26 wherein the hydroxyalkyl derivative of ferrocene is an $\alpha$-hydroxyethyl ferrocene.

30. A process for beneficiating coal, including reducing sulfur and ash, increasing calorific value, and improving other properties, which comprises contacting a coal which contains impurities, such as pyrite or marcasite or other ash-forming minerals, which are substantially liberated from the coal particles, with an iron carbonyl and a member selected from the group consisting of hydrogen and carbon monoxide under reaction conditions which substantially preclude the general thermal dissociation of the carbonyl into iron and carbon monoxide, in order to increase the apparent magnetic susceptibility of the impurities so that a magnetic separation between the coal and impurities may be effected.

31. The process of claim 30 wherein the cotreatment gas comprises hydrogen.

32. A process for beneficiating coal, including reducing sulfur and ash, increasing calorific value, and improving other properties, which comprises contacting a coal which contains impurities, such as pyrite or marcasite or other ash-forming minerals, which are substantially liberated from the coal particles, with iron octoate and a member selected from the group consisting of hydrogen and a carbon monoxide under reaction conditions which substantially preclude the general thermal dissociation of the carbonyl into iron and carbon monoxide, in order to increase the apparent magnetic susceptibility of the impurities so that a magnetic separation between the coal and impurities may be effected.

* * * * *